US010994901B2

(12) United States Patent
Cornelius et al.

(10) Patent No.: US 10,994,901 B2
(45) Date of Patent: May 4, 2021

(54) CAP FOR A DRINKING VESSEL

(71) Applicant: AeroBottle, LLC, Scott City, MO (US)

(72) Inventors: Derek W Cornelius, Cape Girardeau, MO (US); Emmanuel Alvarado, Zapopan (MX); Matthew RC Miller, Scott City, MO (US)

( * ) Notice: Subject to any disclaimer, the term of this patent is extended or adjusted under 35 U.S.C. 154(b) by 0 days.

(21) Appl. No.: 16/188,901

(22) Filed: Nov. 13, 2018

(65) Prior Publication Data

US 2020/0148430 A1 May 14, 2020

(51) Int. Cl.

| | |
|---|---|
| ***B65D 47/08*** | (2006.01) |
| ***B65D 47/12*** | (2006.01) |
| ***B65D 47/14*** | (2006.01) |
| ***B65D 41/04*** | (2006.01) |

(52) U.S. Cl.

CPC ..... *B65D 47/088* (2013.01); *B65D 41/04* (2013.01); *B65D 47/123* (2013.01); *B65D 47/143* (2013.01); *B65D 2251/0025* (2013.01); *B65D 2251/0078* (2013.01); *B65D 2251/023* (2013.01)

(58) Field of Classification Search

CPC ..... B65D 51/18; B65D 47/088; B65D 41/04; B65D 51/242; B65D 47/0885; B65D 47/0895

See application file for complete search history.

(56) References Cited

U.S. PATENT DOCUMENTS

| | | | | |
|---|---|---|---|---|
| 3,307,752 | A | 3/1967 | Anderson | |
| 3,944,104 | A * | 3/1976 | Watson | B65D 41/0421 215/307 |
| D537,676 | S | 3/2007 | Kingsley | |
| D638,658 | S | 5/2011 | Staton | |
| D646,919 | S | 10/2011 | Nilsson | |
| 8,403,173 | B2 | 3/2013 | Wahl | |
| D687,661 | S | 8/2013 | Cetera | |
| D690,989 | S | 10/2013 | Cetera | |
| D691,849 | S | 10/2013 | Cetera | |
| D692,276 | S | 10/2013 | Cetera | |
| D699,996 | S | 2/2014 | De Leo | |
| 8,695,830 | B2 * | 4/2014 | Meyers | B65D 51/242 220/254.3 |
| 8,777,040 | B2 * | 7/2014 | Wahl | A47G 19/2266 215/237 |
| D726,476 | S | 4/2015 | Ercanbrack | |
| D730,694 | S | 6/2015 | Elsaden | |
| D739,174 | S | 9/2015 | Elsaden | |
| D739,674 | S | 9/2015 | Bergstrom | |
| 9,216,843 | B2 | 12/2015 | Sorensen | |
| D748,478 | S | 2/2016 | Sorensen | |
| D752,382 | S | 3/2016 | Ksiazek | |
| D758,127 | S | 6/2016 | Zhao | |

(Continued)

*Primary Examiner* — Jeffrey R Allen
(74) *Attorney, Agent, or Firm* — Kevin J. O'Shea

(57) ABSTRACT

A cap for a drinking vessel, and particularly a shaker cup. The claimed cap can be securely attached to the drinking vessel or shaker cup to avoid leaks, and also includes a sealable opening through which the contents of the drinking vessel can be poured or drunk and a handle that is convenient for a user and which is attached to the cap in such a manner that the handle moves somewhat freely relative to the cap and the mechanism for closing the opening in the cap. Any non-integral components that come into contact with the contents of the vessel are easily detachable to facilitate thorough cleaning.

18 Claims, 9 Drawing Sheets

(56) References Cited

U.S. PATENT DOCUMENTS

| | | | | | |
|---|---|---|---|---|---|
| D763,688 | S | | 8/2016 | Breit | |
| D772,652 | S | | 11/2016 | Yao | |
| D786,072 | S | * | 5/2017 | Breit | D9/443 |
| D807,110 | S | | 1/2018 | Lown | |
| D817,085 | S | | 5/2018 | Davis | |
| 2009/0301990 | A1 | * | 12/2009 | Cresswell | A45F 3/18 215/344 |
| 2017/0107023 | A1 | | 4/2017 | Miksovsky | |

* cited by examiner

CAP FOR A DRINKING VESSEL

BACKGROUND OF THE INVENTION

This invention relates, generally, to caps for shaker cups and similar drinking vessels. More specifically, this invention is an inventive, reusable cap designed to allow a user to easily and comfortably transport, as well as securely close, a shaker cup or similar vessel, allow the user to mix ingredients in the shaker cup or similar vessel without leakage, and allow the user to drink from the shaker cup or similar drinking vessel.

Various types of caps for shaker cups and similar drinking vessels have been developed. These caps generally are joined to the vessel in some manner to prevent leakage from the vessel while a user is drinking from the vessel and/or while the vessel is being transported, and/or when the vessel is being shaken to mix the contents, as in the case of a shaker cup. Typically, the cap is screwed or snapped onto the vessel once the user has placed contents such as water, ice, powders, etc. into the vessel, to provide a leak-proof enclosure.

The user can remove the cap from the vessel to drink the contents of the vessel or, if the cap is designed appropriately, the user can drink from the vessel via an opening in the cap, such as a hole, nozzle or push-pull spout. Any such opening should be sealable to avoid spilling the contents when the user is not drinking from the vessel. The opening can be sealed by, e.g., a flip top closure sealed against, or within, the spout to prevent leakage, such as the closures shown in U.S. Pat. Nos. 8,833,586 and D626,838, and in co-pending U.S. patent application Ser. No. 15/197,367 to Cornelius. Alternatively, the opening can be sealed by a screw top, which is more secure than a flip top closure. Screw top closures also require less effort to open than is required for a flip top, which, as Meyers et al. note in U.S. Pat. No. 8,833,586, requires the user to press upward on a front of the flip top until the upward pressure overcomes the tension holding the flip top closure sealed against the spout. Screw top closures, on the other hand, only require a user to twist the screw cap to unseal the opening in the cap. No matter the type of closure, it is preferable that the closure be connected in some fashion to the cap to avoid dropping or losing the closure when it is not secured to the spout.

In addition to sealing a vessel to avoid leakage of the contents, a cap may also provide a means for carrying the vessel via, e.g., a handle connected to, or integrated into, the cap. Such a handle allows a user to comfortably and easily carry the vessel to which the cap is connected without having to grasp the vessel, which may have a diameter and/or form that makes grasping the vessel itself uncomfortable for some users. Examples of such handles are shown in U.S. Pat. Nos. D780,516, 8,833,586, and D626,838.

It is typical for users to handle vessels, including shaker cups, roughly, e.g., by throwing the vessel into a gym bag or into the seat of a vehicle, or placing the vessel into a carrier that is knocked around during physical activity such as hiking, cycling, running, and weight training. Thus, it is important that the handle be securely connected to the cap so that the vessel, with the cap attached, does not separate from the handle, which would cause the contents to spill out of the vessel.

In addition to being securely connected to the cap to avoid unintended separation of the vessel/cap and handle, the handle must be configured so that it does not impede the user's ability to use the vessel. For example, it is highly annoying for a handle to swing down and hit the user in the face when the user tilts the vessel to drink from it. While this can be achieved by integrating the handle into the cap, as shown in, e.g., U.S. Pat. No. D780,516, or integrating the handle with the closure mechanism that seals the spout, as shown in, e.g., U.S. Pat. No. 8,833,586, such configurations do not allow the handle to move independent of the vessel/cap combination when a user is carrying the vessel/cap via the handle. Furthermore, integrating the handle with the spout closure mechanism, as disclosed in U.S. Pat. No. 8,833,586, introduces the additional problem that inadvertent downward pressure on the handle, such as when another object presses the handle or the user tosses the vessel/cap so that the vessel lands upside down, or nearly upside down, and the weight of the vessel and its contents presses on the handle, could cause the spout closure mechanism to open, spilling the contents of the vessel. This is particularly true when, as in U.S. Pat. No. 8,833,586, the closure mechanism is a flip top. Thus, it is preferred that the handle be connected to the cap in a manner that allows the handle to move independent of the closure mechanism, not only for user comfort and convenience but also to avoid inadvertent spills. Nevertheless, it remains important for the handle to not move so freely that it swings down and hits the user's face when the user is drinking from the vessel, or pouring out the contents, via the opening in the cap.

In addition to the foregoing, it is preferable that the handle be configured to allow a user to carry it easily, e.g., by inserting a finger, carabiner, belt, tie, or the like, through an opening in the handle. This makes the handle easier and more convenient to use, e.g., when the user is carrying multiple items.

Shaker cups such as the ones disclosed in U.S. Pat. Nos. D780,516, D736,559, D723,325, and 6,379,032, and similar vessels, allow a user to mix multiple ingredients, e.g., a protein powder and water, or a flavoring powder and water, by placing the ingredients together into the shaker cup, closing the shaker cup with a cap, and shaking the shaker cup until the ingredients are properly mixed. Such shaker cups may present additional concerns with respect to the cap used with the shaker cup. For example, shaker cups require a particularly good seal between the shaker cup and the cap due to the vigorous movement of the contents of the shaker cup, which may include a separate mixing element inside the shaker cup such as a wireframe piece, when a user is shaking the cup to mix the ingredients. Moreover, the ability to clean internal portions of the cap that come into contact with the ingredients when they are being mixed in a shaker cup is particularly important. For example, when a powder is mixed with a liquid, or two liquids are mixed together, in a vessel such as a shaker cup, small amounts of the resulting mixture tend to become trapped in internal portions of the cap, e.g., a sealing ring or screw threads, and potentially in the mechanism that seals the spout. This can cause an unsanitary condition, as well as unpleasant odors, if the cap components that come into contact with the contents mixed in the shaker cup are not thoroughly cleaned. Therefore, any components of a cap that may be used with a vessel in which ingredients are mixed should be either formed as part of the cap or easily detachable so that such components can be thoroughly cleaned.

BRIEF SUMMARY OF THE INVENTION

The present invention relates to a vessel cap, and particularly a shaker cup cap, that can be securely attached to the vessel or shaker cup to avoid leaks, and also includes a sealable opening through which the vessel contents can be poured or drunk and a handle that is convenient for a user to use and which is attached to the cap in such a manner that the handle moves somewhat freely relative to the cap and the mechanism for closing the opening in the cap. Any non-integral components that come into contact with the contents of the vessel are easily detachable to facilitate thorough cleaning.

DESCRIPTION OF THE PREFERRED EMBODIMENT

Figure 1:
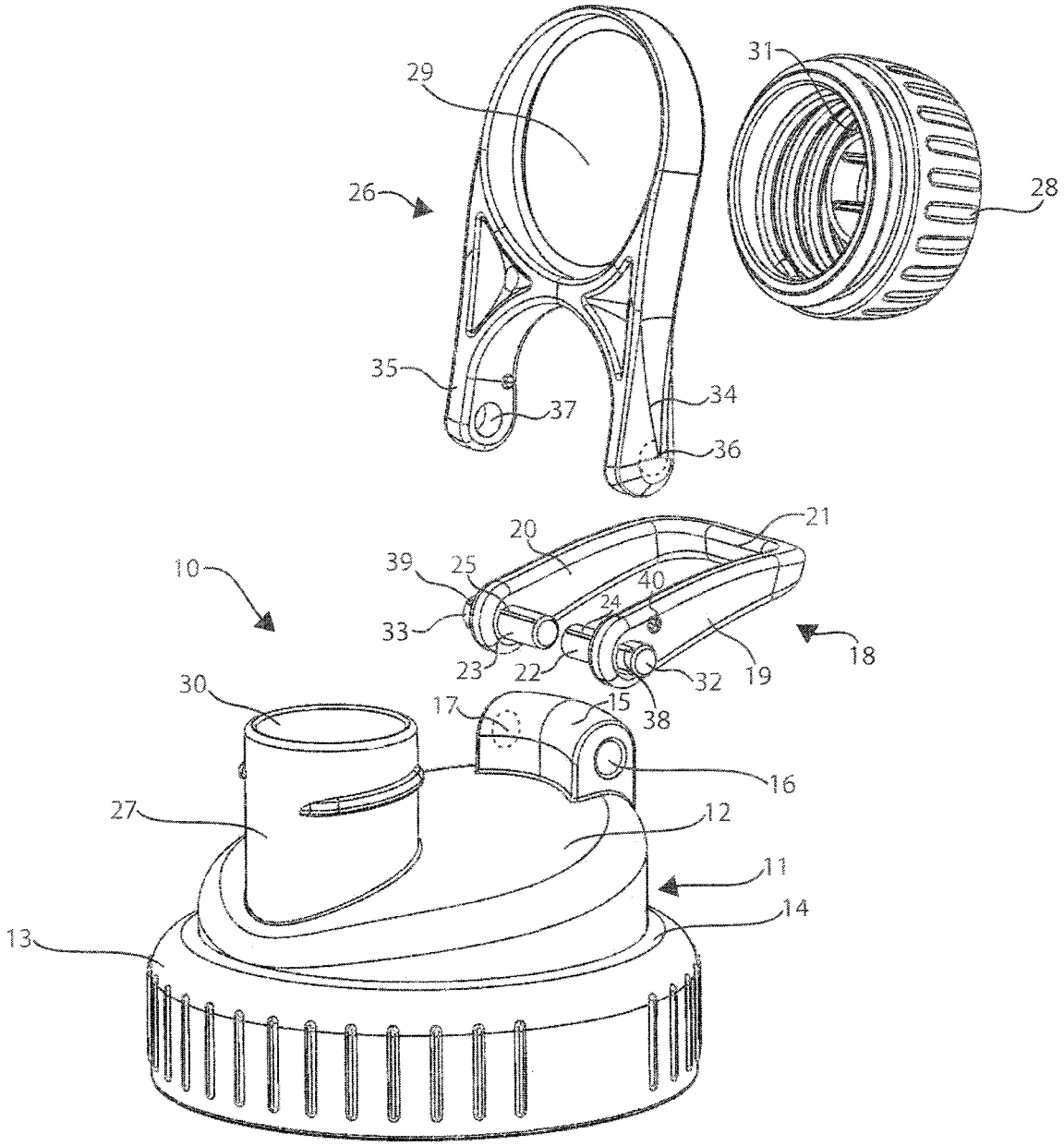
FIG. 1 is an exploded quarter perspective view of an embodiment of the present invention.
Figure 2:
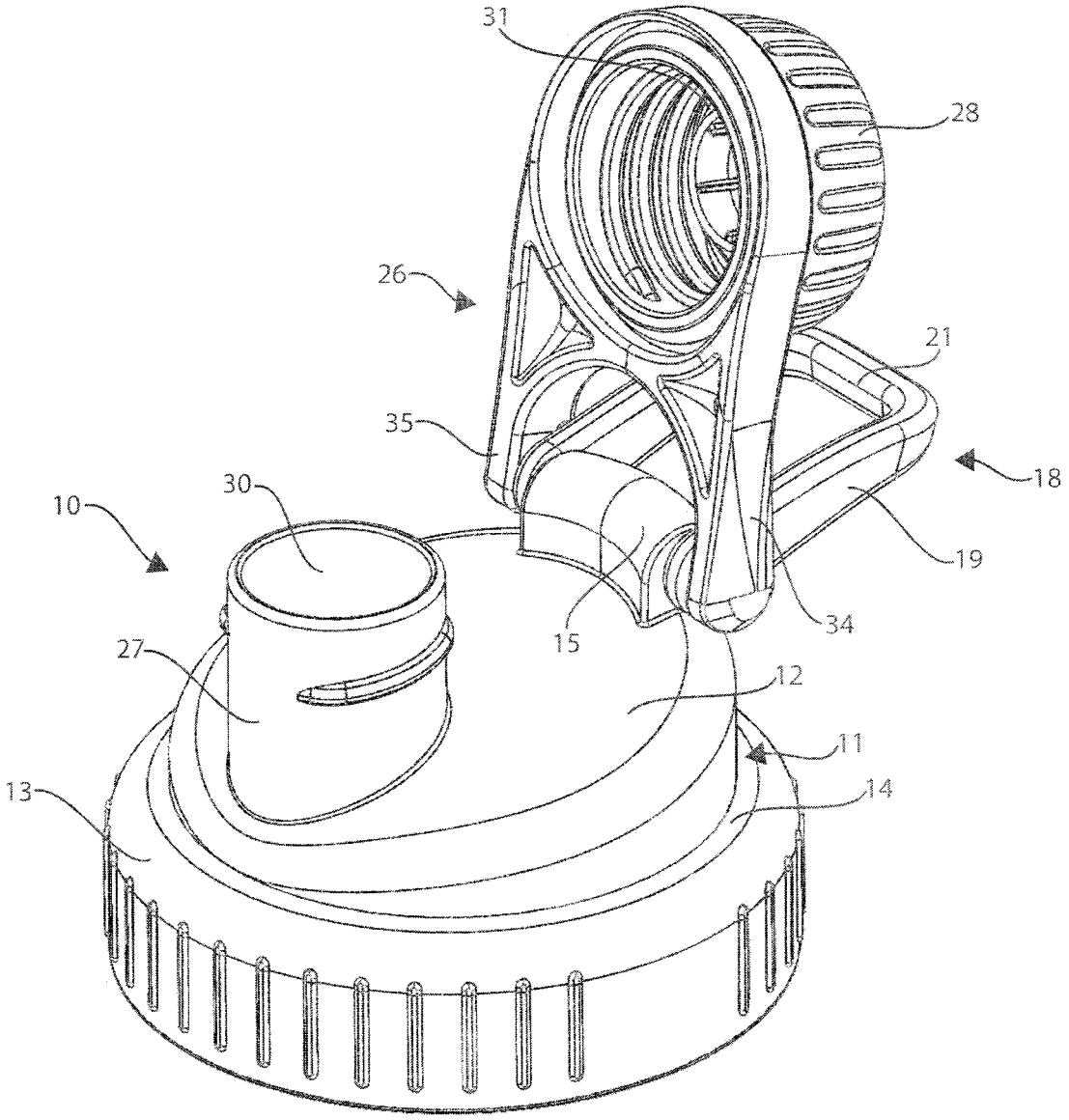
FIG. 2 is a quarter perspective view of an embodiment of the present invention.
Figure 3:
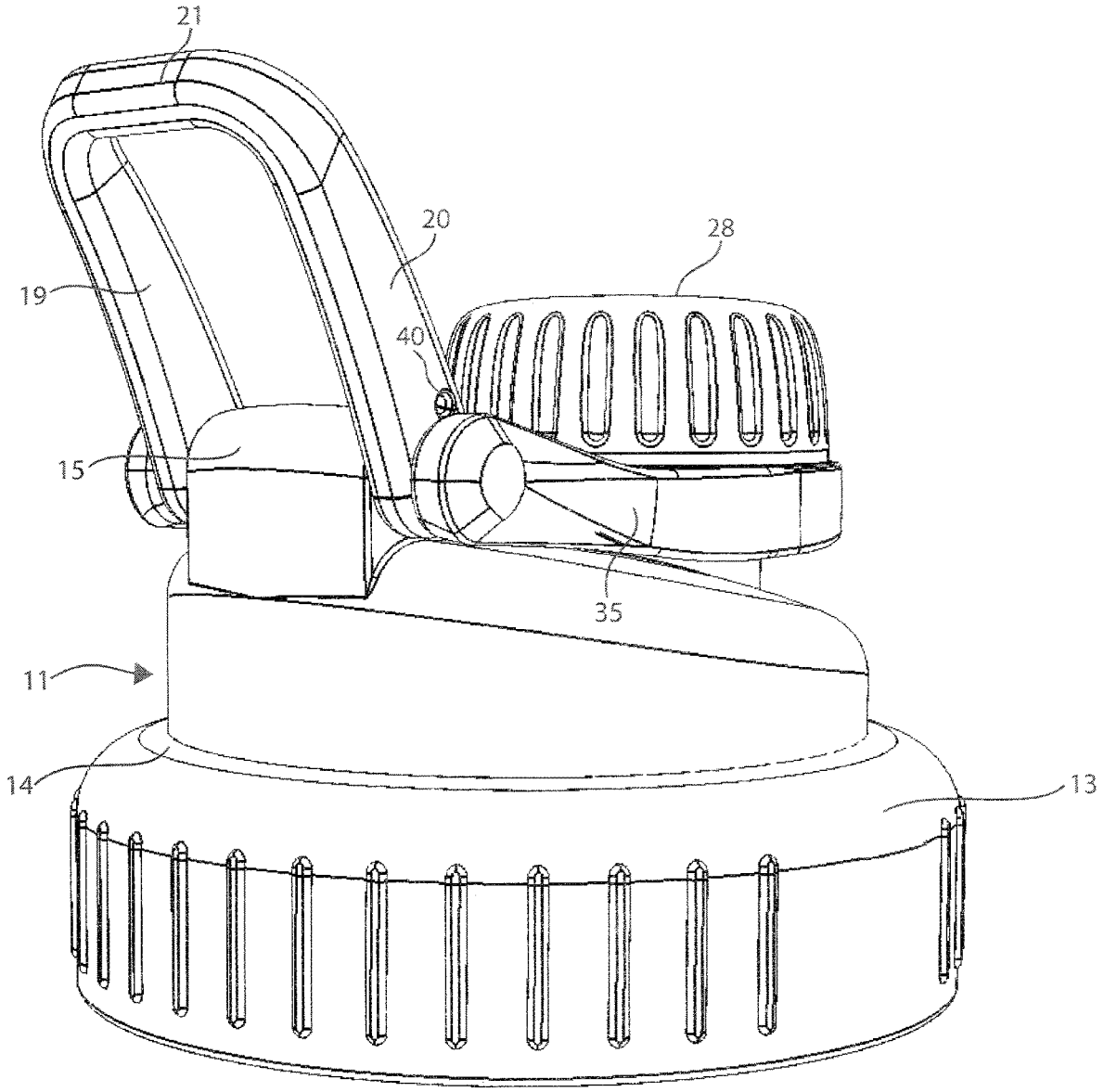
FIG. 3 is a quarter perspective view of an embodiment of the present invention.
Figure 4:
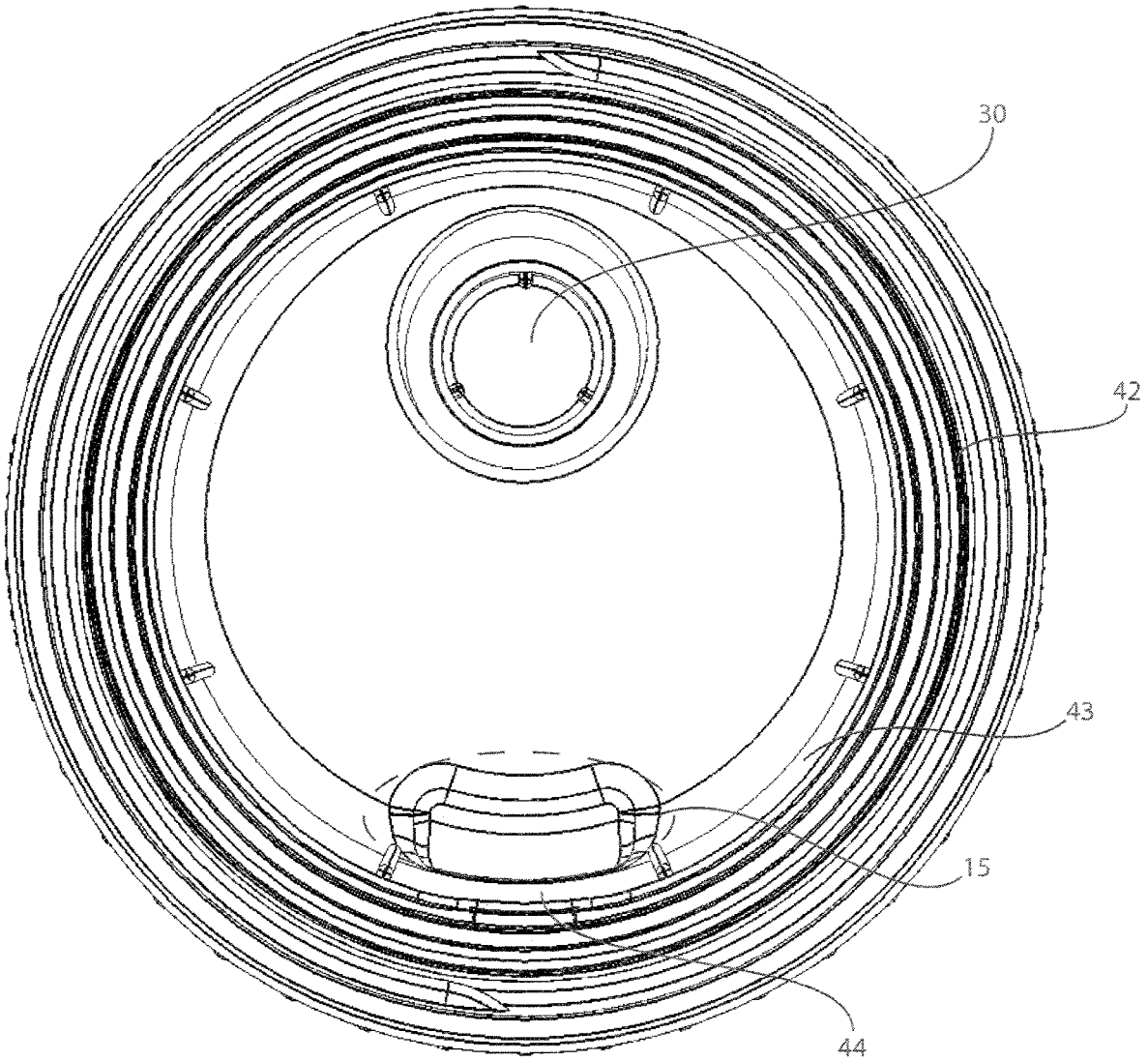
FIG. 4 is a bottom view of an embodiment of the present invention
Figure 5:
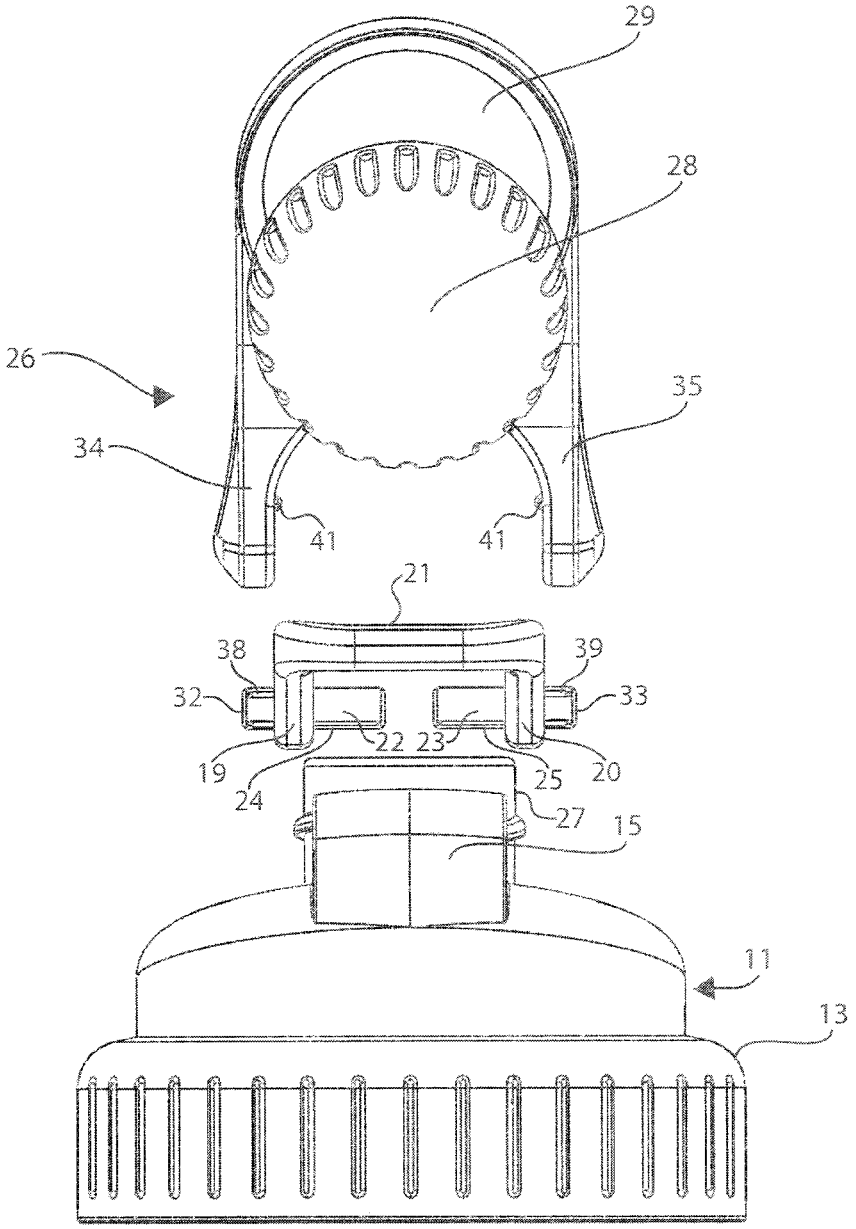
FIG. 5 is an exploded view of an embodiment of the present invention from the back.
Figure 6:
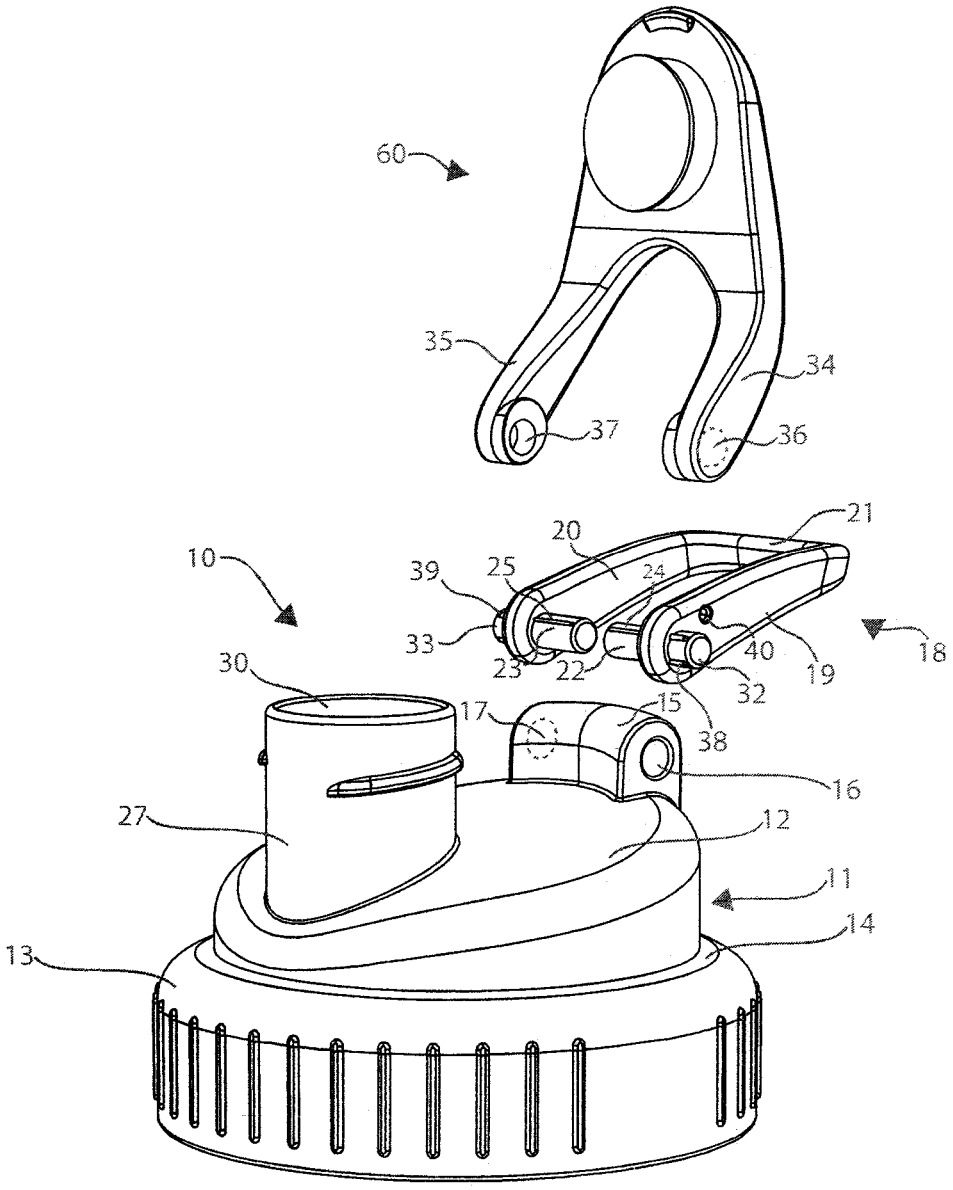
FIG. 6 is a quarter perspective view of an embodiment of the present invention.
Figure 7:
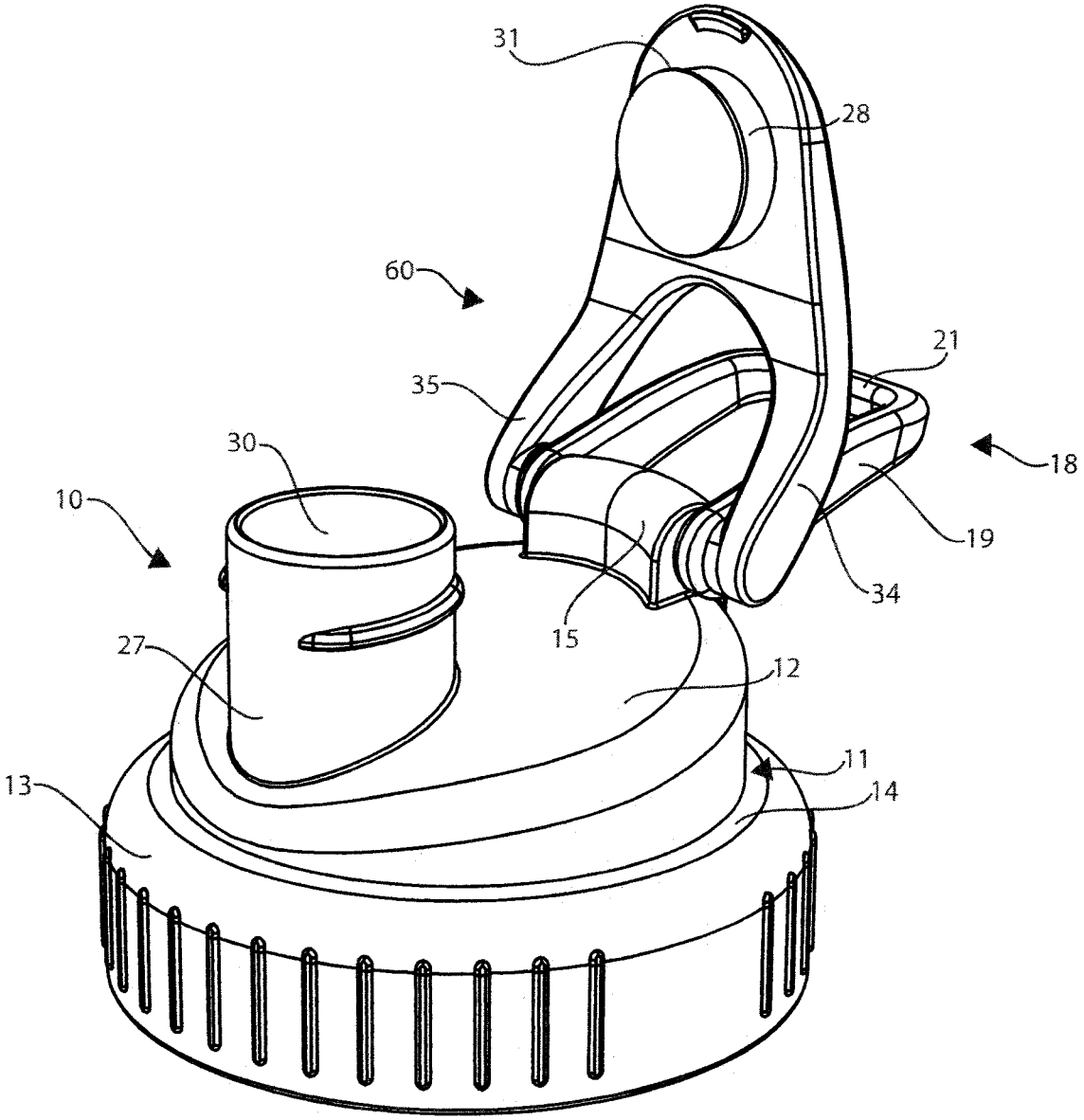
FIG. 7 is a quarter perspective view of an embodiment of the present invention.
Figure 8:
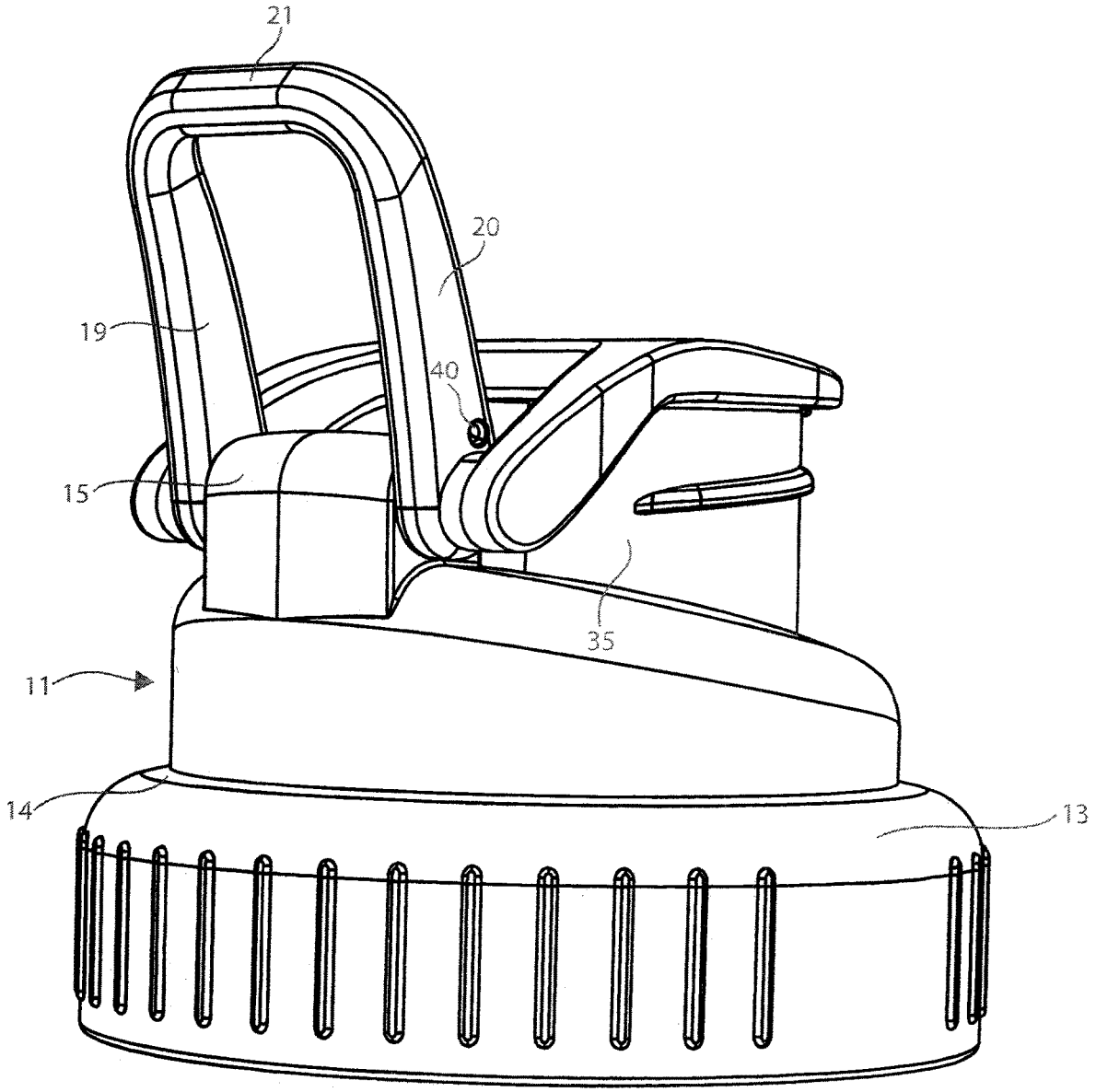
FIG. 8 is a quarter perspective view of an embodiment of the present invention.
Figure 9:
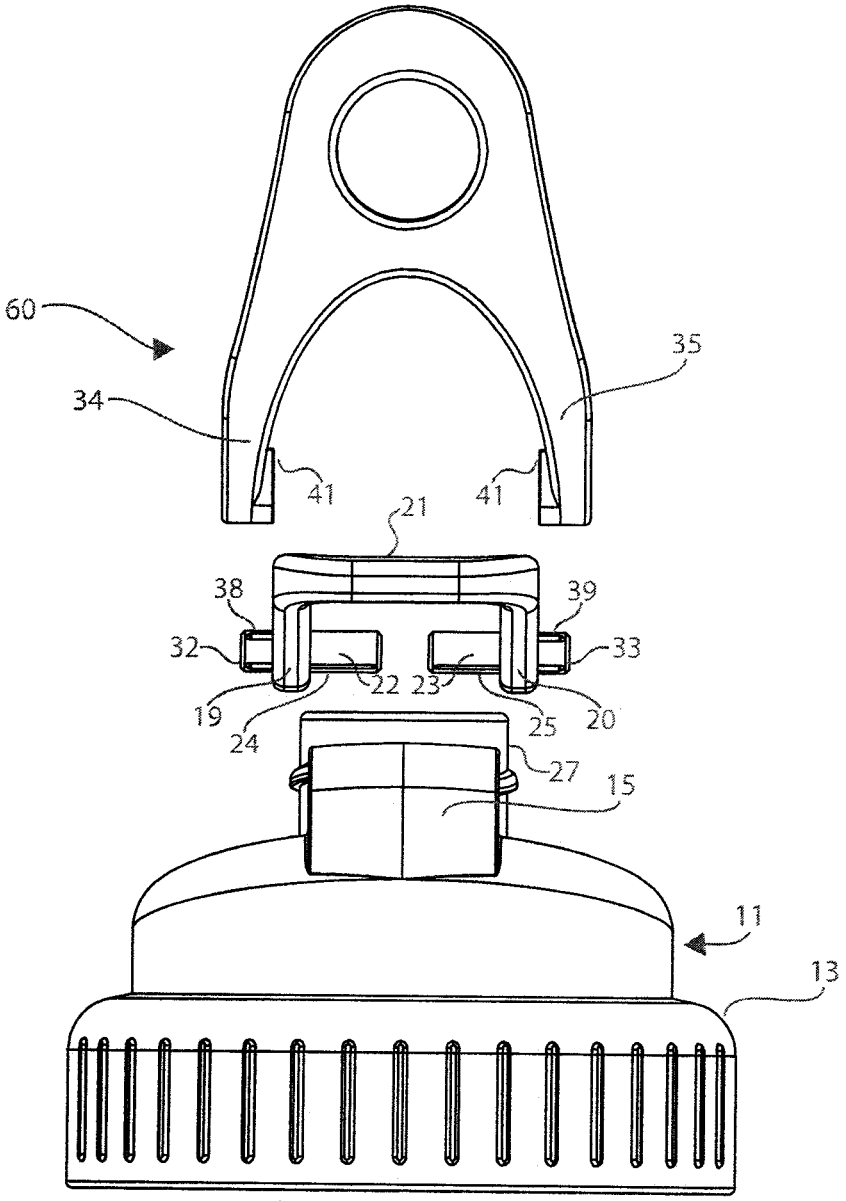
FIG. 9 is an exploded view of an embodiment of the present invention from the back.

While this invention is susceptible of embodiment in many different forms, there is shown in the drawings and will herein be described in detail preferred embodiments of the invention with the understanding that the present disclosure is to be considered exemplary of the principles of the invention and is not intended to limit the broad aspect of the invention to the disclosed embodiments.

The present invention comprises an improved cap for a vessel, and preferably for a shaker cup, that can be securely attached to the vessel to avoid leaks, and also includes an opening through which a user can pour or drink the contents of the vessel, and a mechanism for sealably closing the opening. The present invention further comprises a handle that is convenient and simple for a user to use and which is attached to the cap in such a manner that the handle moves somewhat freely relative to the cap and the mechanism for closing the opening in the cap. Any non-integral components of the cap that come into contact with the contents of the vessel are easily detachable to facilitate thorough cleaning.

Circular body 11 comprises top surface 12, which may be flat, rounded, angled or any other desired configuration. If top surface 12 is angled, as shown in the Figures, a preferable angle is from about 10 to about 33 degrees relative to the plane of the bottom of circular body 11. More preferably, top surface 12 is angled from about 10 to about 25 degrees relative to the plane of the bottom of the body, and even more preferably the top surface 12 is angled about 10 degrees relative to the plane of the bottom of the body. The presently described preferred embodiment of cap 10 further comprises skirt wall 13 extending downward from circular body 11. Skirt wall 13, as shown in the Figures, has a greater diameter than the diameter of circular body 11 and is connected to circular body 11 via second top surface 14. Those of ordinary skill in the art will appreciate that this is merely a design choice, and that circular body 11 and skirt wall 13 may have the same diameter, such that skirt wall 13 would extend downward directly from circular body 11, or different diameters without affecting the scope of the present invention.

Pivot hinge mount 15 has an axis of rotation and comprises openings 16 and 17 on opposing sides of pivot hinge mount 15. As is understood by those of skill in the art, openings 16 and 17 may be independent of one another, with a solid portion of pivot hinge mount 15 between them, or they may be two ends of a single opening passing fully through pivot hinge mount 15, or any other design choice that achieves the intended purpose of allowing attachment of carrying member 18 to pivot hinge mount 15. Such design choices can be made by those of skill in the art without affecting the scope of the present invention.

Carrying member 18 is preferably a u-shaped handle comprising arms 19 and 20 extending from connecting arm 21 that connects arms 19 and 20. This preferred u-shape allows a user to insert a finger, carabiner, belt, tie, or the like, through the opening formed by arms 19, 20, and 21. Carrying member 18 is detachably connected to pivot hinge mount 15 in such a manner that carrying member 18 is able to move somewhat freely about the axis of rotation of pivot hinge mount 15. Each of arms 19 and 20 comprises a member, 22 and 23 respectively, positioned at the end of the respective arm furthest from connecting arm 21 and extending inward from respective arms 19 and 20. Members 22 and 23 are inserted into openings 16 and 17, respectively, to detachably connect carrying member 18 to pivot hinge mount 15. The diameter(s) of members 22 and 23 is preferably identical and sized so that members 22 and 23 fit snugly into openings 16 and 17, respectively, in pivot hinge mount 15. This allows carrying member 18 to move somewhat freely, but not loosely, about the axis of rotation of pivot hinge mount 15. Members 22 and 23 may comprise one or more protrusions, 24 and 25 respectively, formed in any desired shape and size to achieve a desired amount and ease of rotation for carrying member 18 about the axis of rotation of pivot mount 15. For example, a particular size and/or shape for protrusions 24 and/or 25 could create specified stopping points for rotation of carrying member 18, so that a user is able to rotate carrying member 18 to a desired position or exert additional pressure to move carrying member 18 to a different position where it will remain. Alternatively, protrusions 24 and 25 may be designed to allow smooth, uninterrupted rotation of carrying member 18 that nonetheless requires the user to exert a certain amount of pressure, such that carrying member 18 does not rotate unimpeded. Design choices such as the diameter of members 22 and 23, and the shape and size of protrusions 24 and 25, for a desired freedom of movement for carrying member 18 are well known to those of skill in the art and the present invention encompasses all such design choices.

Holder 26 comprises a first end in which opening 29 is positioned. Closing member 28 is secured within opening 29 in such a manner that a user can remove closing member 28, e.g., for cleaning, without substantial effort, though closing member 28 is sufficiently secured within opening 29 that closing member 28 will not easily fall out. Spout 27 comprises opening 30 through which a user may pour or drink the contents of a vessel to which cap 10 is attached. Closing member 28 engages with spout 27 in such a manner that closing member 28 seals opening 30, preferably in a leak-proof manner but at least in a leak-resistant manner.

Closing member 28 comprises a sealing member 31 that is preferably made of silicone, plastic or the like and configured as an o-ring, as shown in the Figures, or any similar device that prevents fluid from leaking through opening 30 when closing member 28 is engaged with spout 27. The profile of sealing member 31 may be designed to create a more secure seal between closing member 28 and spout 27. For example, sealing member 31 may be formed such that its outer wall, which is in contact with closing member 28, is shorter than the inner wall of sealing member 31 so that when closing member 28 is secured against spout 27 to seal opening 30, the inner wall of sealing member 31 partially or fully enters opening 30. It should be noted that closing member 28 is depicted in the Figures as a screw cap but those of skill in the art will understand that closing member 28 may comprise any mechanism, e.g., a flip top, which provides a leak-proof or leak-resistant seal to opening 30 in spout 27. When, as shown in the Figures, closing member 28 is a screw cap, in addition to the issues noted above, it must be secured within opening 29 in such a manner that a user can turn closing member 28 to screw it onto, and off of, spout 26.

Each of carrying member arms 19 and 20 further comprises a second member, 32 and 33 respectively, on the outside of arms 19 and 20, and positioned opposite members 22 and 23, respectively. Holder 26 further comprises arms 34 and 35 extending away from the first end of holder 26. Each of arms 34 and 35 has an opening, 36 and 37 respectively, positioned at the end of the arm farthest from the first end of holder 26. Members 32 and 33 are inserted into openings 36 and 37, respectively, so that holder 26 is detachably connected to carrying member 18, which is detachably connected to pivot hinge mount 15. Thus, holder 26 is able to rotate about the axis of rotation of pivot hinge mount 15 independently of carrying member 18.

Preferably, members 32 and 33, and openings 36 and 37 are sized to provide a snug fit so that holder 26 is able to move somewhat freely, but not loosely, about the axis of rotation of pivot hinge mount 15. Members 32 and 33 may comprise one or more protrusions, 38 and 39 respectively, formed in any desired shape and size to achieve a desired amount and ease of rotation for carrying member 18 about the axis of rotation of pivot mount 15. For example, a particular size and/or shape for protrusions 38 and/or 39 could create specified stopping points for rotation of holder 26, so that a user is able to rotate holder 26 to a desired position or exert additional pressure to move holder 26 to a different position where it will remain. Alternatively, protrusions 38 and/or 39 may be designed to allow smooth, uninterrupted rotation of holder 26 that nonetheless requires the user to exert a certain amount of pressure, such that holder 26 does not rotate unimpeded. Design choices such as the diameter of members 32 and 33, and the shape and size of protrusions 38 and 39, for a desired freedom of movement for holder 26 are well known to those of skill in the art and the present invention encompasses all such design choices.

In one embodiment of the present invention, one or both of carrying member arms 19 and 20 further comprises member 40 located on the outside of carrying member arms 19 and 20, closer to connecting arm 21 than to members 32 and 33. Member 40 interacts with holder 26 to secure carrying member 18 to holder 26 so that when a user exerts pressure on one of these components, both components rotate together about the axis of rotation of pivot hinge arm 15. In an alternative embodiment, one or both of holder arms 33 and 34 further comprises member 41 located on the inside of the arm(s), closer to the first end of holder 26 than to openings 36 and 37. In this embodiment, member 41 interacts with carrying member 18 to secure holder 26 to carrying member 18 so that when a user exerts pressure on one of these components, both components rotate together about the axis of rotation of pivot hinge arm 15.

Cap 10 preferably includes threads 42 so that it may be screwed onto a vessel to prevent leaks from the vessel when cap 10 is attached to the vessel. Alternatively, any other well-known configuration for connecting cap 10 to a vessel, e.g., a snap-top configuration, is within the scope of the present invention. Regardless of the means by which cap 10 is connected to a vessel, cap 10 further comprises a sealing member 43 that is preferably made of silicone, plastic or the like and configured as an o-ring, as shown in the Figures, or any similar device that prevents fluid from leaking out of a vessel to which cap 10 is attached. Sealing member 43 is secured in place to avoid it being dislodged during use of the vessel, such as when a user shakes a shaker cup with cap 10 attached, when cap 10 is removed from the vessel, and/or when cap 10 is being washed by hand or in a dishwasher.

A user may place powder or other ingredients into a vessel such as a shaker cup before attaching cap 10 to the vessel, and portions of such ingredients tend to become trapped in components of cap 10 such as the present invention, causing unpleasant odors and unsanitary conditions. Therefore, sealing member 43 is preferably removable from cap 10 for independent cleaning. In order to allow a user to remove sealing member 43 from cap 10, e.g., to clean or replace sealing member 43, in one embodiment of the present invention cap 10 further comprises opening 44 which allows a user to easily grasp sealing member 43 for removal and/or wrest sealing member 43 from cap 10. Opening 44 may be configured as, e.g., a notch sized to accommodate the tip of a user's finger.

As is well-known in the art, multiple components of cap 10 may be integrally formed as a unitary structure. Thus, for example, circular body 11, second top surface 14, spout 27, pivot hinge mount 15, and skirt wall 13 may be formed as a single unitary structure. Any appropriate material known to those of skill in the art, e.g., polypropylene or silicone for various elements described herein, may be used to manufacture cap 10.

The full scope of the present invention is indicated by the claims, rather than by the foregoing description of certain embodiments.

What is claimed is:

1. A container lid comprising:

a lid body with a spout having an opening for dispensing liquid;

a hinge mount having a first opening, a second opening opposite the first opening, and an axis of rotation;

a carrying member comprising a first arm having a first protrusion extending inward from the interior surface of the first arm and a second protrusion extending outward from the exterior surface of the first arm, and a second arm having a first protrusion extending inward from the interior surface of the second arm and a second protrusion extending outward from the exterior surface of the second arm;

the first protrusion of the first arm of the carrying member being inserted into the first opening of the hinge mount, and the first protrusion of the second arm of the carrying member being inserted into the second opening of the hinge mount;

a holder comprising a first end having an opening, a first arm extending away from the first end, and a second arm extending away from the first end;

a closing member secured within the opening in the first end of the holder;

the first arm of the holder having an opening in the end of the first arm of the holder opposite from the opening of the holder;

the second arm of the holder having an opening in the end of the second arm of the holder opposite from the opening of the holder;

the second protrusion of the first arm of the carrying member being inserted into the opening of the first arm of the holder, and the second protrusion of the second arm of the carrying member being inserted into the opening of the second arm of the holder; and means for creating a leak-resistant seal between the closing member secured within the opening in the first end of the holder and the spout.

2. The container lid of claim 1, wherein the first protrusion of the first arm of the carrying member and the first protrusion of the second arm of the carrying member are configured to connect the carrying member to the hinge mount and allow rotation of the carrying member about the axis of rotation of the pivot mount independent of the holder.

3. The container lid of claim 2, wherein each of the first protrusion of the first arm of the carrying member and the first protrusion of the second arm of the carrying member comprises a multitude of projections around the diameter of each said protrusion.

4. The container lid of claim 1, wherein the second protrusion of the first arm of the carrying member and the second protrusion of the second arm of the carrying member are configured to connect the carrying member to the holder and allow the carrying member to rotate about the axis of rotation of the pivot mount independent of the holder.

5. The container lid of claim 4, wherein each of the second protrusion of the first arm of the carrying member and the second protrusion of the second arm of the carrying member comprises a multitude of projections around the diameter of each said protrusion.

6. The container lid of claim 1, wherein the carrying member is rotatable about the axis of rotation of the hinge mount independent of the holder.

7. The container lid of claim 1, wherein the holder is rotatable about the axis of rotation of the hinge mount independent of the carrying member.

8. The container lid of claim 1, further comprising means for releasably connecting the carrying member and the holder in a manner that allows the carrying member and the holder to be rotated together about the axis of rotation of the hinge mount.

9. The container lid of claim 1, wherein the closing member is a screw cap.

10. The container lid of claim 1, wherein the closing member is a snap cap.

11. A container lid comprising:

a lid body with a spout having an opening for dispensing liquid;

a hinge mount having a first opening, a second opening opposite the first opening, and an axis of rotation;

a carrying member comprising a first arm having a first protrusion extending inward from the interior surface of the first arm and a second protrusion extending outward from the exterior surface of the first arm, and a second arm having a first protrusion extending inward from the interior surface of the second arm and a second protrusion extending outward from the exterior surface of the second arm;

the first protrusion of the first arm of the carrying member being inserted into the first opening of the hinge mount, and the first protrusion of the second arm of the carrying member being inserted into the second opening of the hinge mount;

a snap cap comprising a first arm and a second arm;

the first arm of the snap cap having an opening;

the second arm of the snap cap having an opening; and the second protrusion of the first arm of the carrying member being inserted into the opening of the first arm of the snap cap, and the second protrusion of the second arm of the carrying member being inserted into the opening of the second arm of the snap cap.

12. The container lid of claim 11, wherein the first protrusion of the first arm of the carrying member and the first protrusion of the second arm of the carrying member are configured to connect the carrying member to the hinge mount and allow rotation of the carrying member about the axis of rotation of the pivot mount independent of the snap cap.

13. The container lid of claim 12, wherein each of the first protrusion of the first arm of the carrying member and the first protrusion of the second arm of the carrying member comprises a multitude of projections around the diameter of each said protrusion.

14. The container lid of claim 11, wherein the second protrusion of the first arm of the carrying member and the second protrusion of the second arm of the carrying member are configured to connect the carrying member to the snap cap and allow the carrying member to rotate about the axis of rotation of the pivot mount independent of the snap cap.

15. The container lid of claim 14, wherein each of the second protrusion of the first arm of the carrying member and the second protrusion of the second arm of the carrying member comprises a multitude of projections around the diameter of each said protrusion.

16. The container lid of claim 11, wherein the carrying member is rotatable about the axis of rotation of the hinge mount independent of the snap cap.

17. The container lid of claim 11, wherein the snap cap is rotatable about the axis of rotation of the hinge mount independent of the carrying member.

18. The container lid of claim 11, further comprising means for releasably connecting the carrying member and the snap cap in a manner that allows the carrying member and the snap cap to be rotated together about the axis of rotation of the hinge mount.

* * * * *